US005570906A

United States Patent [19]

Giulie

[11] Patent Number: 5,570,906

[45] Date of Patent: Nov. 5, 1996

[54] CORNER BIND APPARATUS AND METHOD

[76] Inventor: Joe D. Giulie, 1170 E. Meadow Dr., Palo Alto, Calif. 94303

[21] Appl. No.: 232,715

[22] Filed: Apr. 25, 1994

[51] Int. Cl.[6] ..... B42D 1/106

[52] U.S. Cl. ..... 281/42; 281/21.1; 281/28

[58] Field of Search ..... 281/42, 20, 21.1, 281/28, 45, 27.3; 116/234–239; 462/71; 40/159.1, 662, 663, 665, 666; 24/67 CF

[56] References Cited

U.S. PATENT DOCUMENTS

| | | | |
|---|---|---|---|
| 295,141 | 3/1884 | Akins . | |
| 302,768 | 7/1884 | Paine | 116/234 X |
| 448,470 | 3/1891 | Barstow | 116/234 |
| 524,647 | 8/1894 | Pancoast . | |
| 536,315 | 3/1895 | Wright et al. | 281/20 |
| 538,706 | 5/1895 | Sexton | 116/234 |
| 768,313 | 8/1904 | Scherf | 281/20 |
| 964,985 | 7/1910 | Bernhardt | 281/20 |
| 1,361,118 | 12/1920 | Upjohn . | |
| 1,676,741 | 7/1928 | Moskowitz | 281/20 |
| 2,265,798 | 12/1941 | Brummer | 116/239 |
| 2,308,628 | 1/1943 | Rider | 281/42 |
| 2,543,144 | 2/1951 | Wold . | |
| 2,728,451 | 12/1955 | Leander | 281/20 X |
| 2,853,043 | 9/1958 | Bitterman et al. | 281/42 X |
| 3,055,680 | 9/1962 | Stoffel | 116/234 X |
| 3,298,714 | 1/1967 | Celmer | 281/42 |
| 3,725,170 | 4/1973 | Doll | 493/352 X |
| 4,571,107 | 2/1986 | Takada | 402/14 |
| 5,212,850 | 5/1993 | Rerolle | 24/67 CF X |
| 5,217,256 | 6/1993 | Lomas | 281/20 |
| 5,272,792 | 12/1993 | Haper | 24/67 CF |

FOREIGN PATENT DOCUMENTS

| | | | |
|---|---|---|---|
| 115870 | 10/1942 | Australia | 402/79 |
| 344496 | 4/1919 | Germany . | |
| 446437 | 4/1936 | United Kingdom | 116/234 |
| 558609 | 1/1944 | United Kingdom . | |

*Primary Examiner*—Frances Han
*Attorney, Agent, or Firm*—Bruce H. Johnsonbaugh

[57] ABSTRACT

A corner bind apparatus and method are provided for binding a plurality of papers together at one corner. An anti-shear device, such as a staple or pressure sensitive adhesive, is used together with an anti-peel device to form the binding. The anti-peel device grips and encloses the corner of the papers. A triangular body is utilized with two triangular tabs extending away from the body, the tabs being folded around the back side of the stack of papers. A flag of various shapes may be attached to the corner bind device.

13 Claims, 7 Drawing Sheets

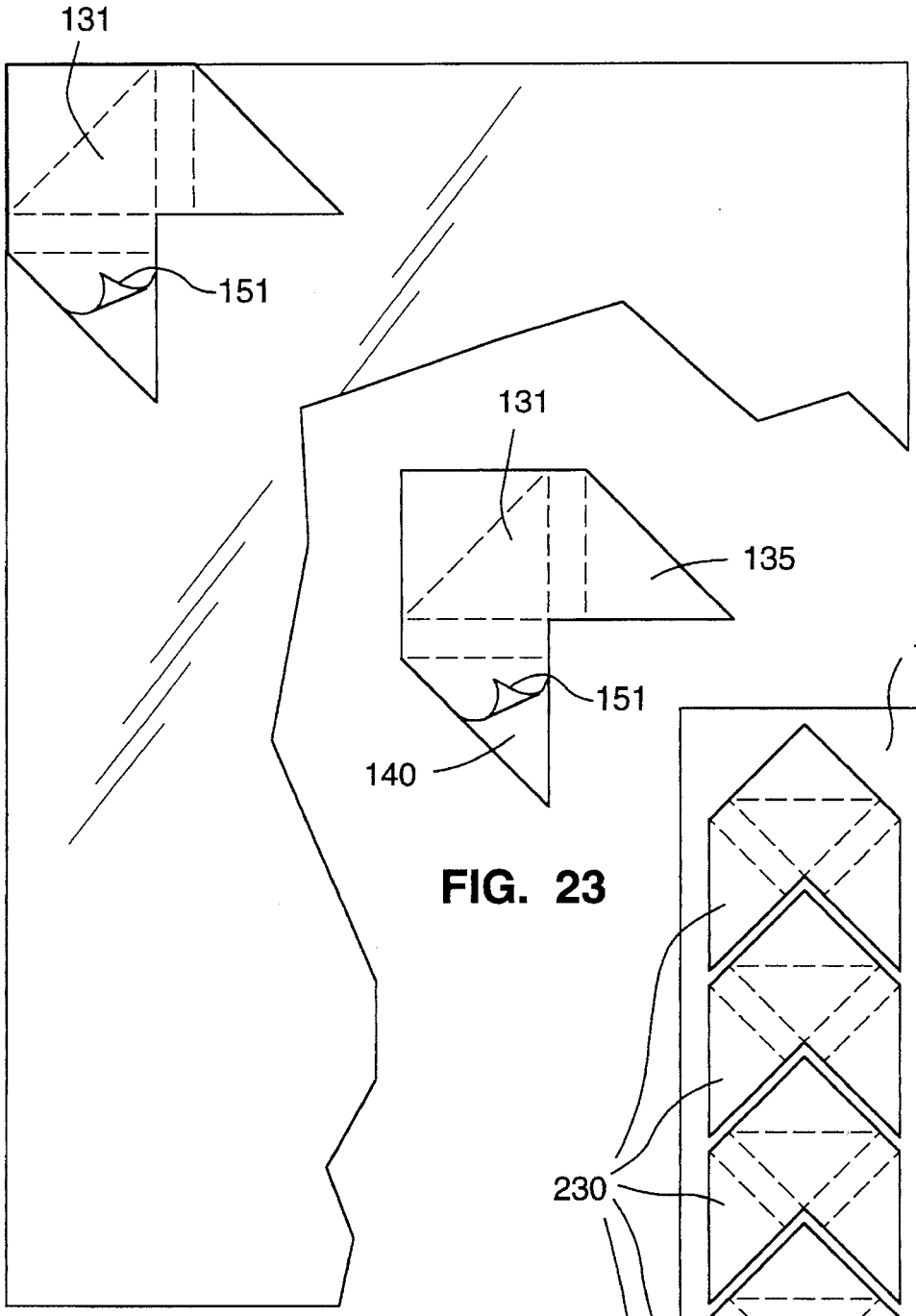
FIG. 23
FIG. 24
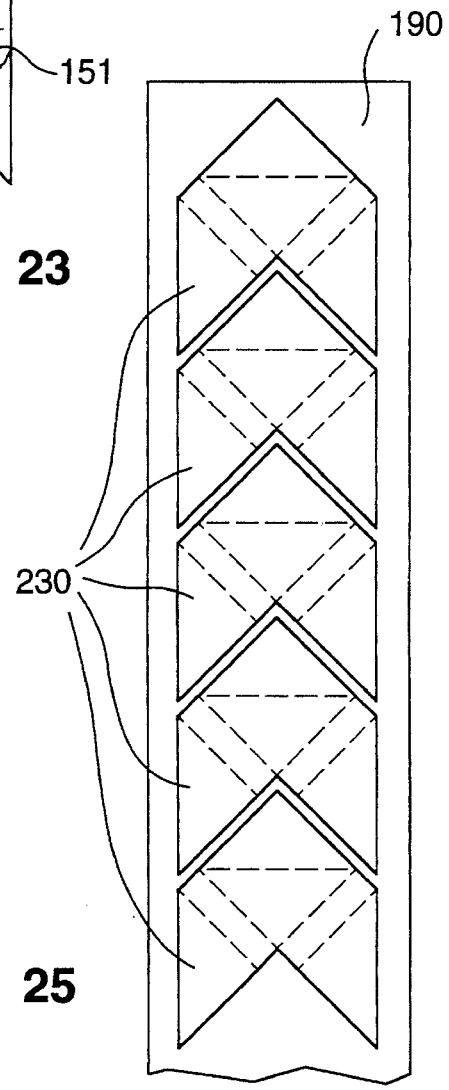
FIG. 25

CORNER BIND APPARATUS AND METHOD

BACKGROUND AND BRIEF SUMMARY OF THE INVENTION

This invention relates generally to the field of binding and, more particularly, to an apparatus and method for binding together a plurality of sheets at one corner.

The art of binding includes a variety of methods for binding together a plurality of sheets. Most of the methods and apparatus employ the technique of binding together one entire edge of the plurality of sheets. Most of these approaches known in the prior art utilize the use of relatively expensive and somewhat cumbersome machines to accomplish the binding function.

The present invention provides a very simple but effective method and apparatus for binding a plurality of sheets together at one corner. The prior art for binding a plurality of sheets at one corner includes the ordinary staple as well as staple covers. Staples are relatively weak in terms of their resistance to "peel," i.e. the lifting of one or more sheets off the other sheets. U.S. Pat. No. 4,571,107 dated Feb. 18, 1986 to Takada teaches a corner cover which is utilized to cover the exposed top and bottom of an ordinary staple with a somewhat decorative cover. However, the cover taught by Takada simply covers the staple and a portion of the corner of the document but does not itself perform a significant binding function.

In contrast to Takada, the present invention provides a very simple corner bind which both grips and encloses one corner of a plurality of sheets.

The prior art also teaches the use of re-fused or remelted xerographic toner as a binder, as shown in U.S. Pat. No. 3,793,016 dated Feb. 19, 1974 to Eichorn. Although remelted toner has adequate resistance to "shear," i.e. the sliding of sheets relative to each other, it is relatively weak in resisting "peel." Eichorn teaches the use of strips of toner running down the left edge of each page as well as toner applied to a corner region, but does not teach the use of an anti-peel device which grips and encloses one corner of a plurality of sheets.

The prior art also includes adhesive corners for fastening and mounting cards and photos such as taught by the Engelmann U.S. Pat. No. 1,927,338 dated Sep. 19, 1933. However, the Engelmann patent does not teach or suggest the use of the corner for binding together a plurality of documents or a plurality of sheets.

A primary object of the present invention is to provide a simple yet effective method and apparatus for binding together a plurality of sheets at one corner.

Another object of the invention is to combine an anti-shear device to one corner of a plurality of sheets, which effectively prevents the sheets from sliding relative to each other, with an anti-peel device which grips and encloses the corner of the sheets to resist the sheets from separating by one or more of the sheets being lifted relative to the remaining sheets.

Another object of the invention is to provide a corner binding apparatus and method wherein a plurality of sheets may be readily and effectively bound at one corner by hand.

Another object of the invention is to provide a corner bind apparatus wherein critical parts of the apparatus may be manufactured and sold in strip form and readily detached by the user when needed.

Another object of the invention is to provide a corner bind apparatus and method which is adaptable to use by automatic machinery.

A further object of the invention is to provide a corner bind apparatus to which a flag may be attached and to which either notes or logos, for example, may be applied.

Other objects and advantages will become apparent from the following description of the preferred embodiments and the drawings wherein:

FIG. 23 is a plan view of yet another embodiment of the invention;

FIG. 24 is a schematic representation of the device of FIG. 23 as applied to a stack of papers;

FIG. 25 is a plan view of a strip of material carrying a supply of the anti-peel device of FIG. 18 which may be readily detached one at a time from the strip;

DETAILED DESCRIPTION OF THE DRAWINGS

FIGS. 1–5 show the application of one embodiment of the invention to a plurality of sheets. Although the invention is intended for use in binding stacks of paper, it is described herein as being applied to a plurality of sheets in the sense that it may be used in conjunction with sheet materials other than paper, such as plastic for example.

Figure 2:
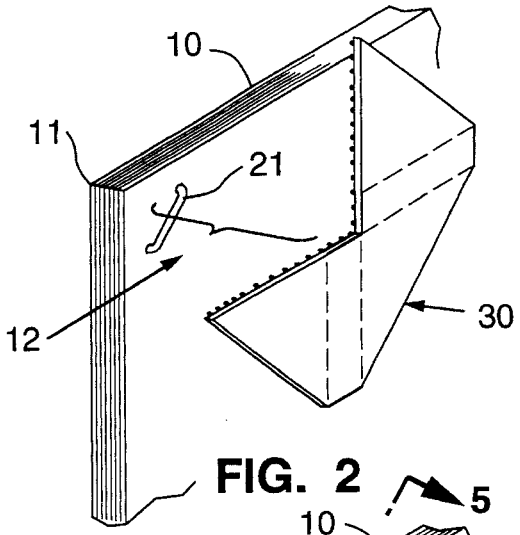
FIG. 2 is a perspective, exploded view showing a plurality of papers to which a staple has been applied as the anti-shear device and to which the anti-peel apparatus of FIG. 1 is about to be applied.

A plurality of sheets 10 as shown in FIG. 2 has one corner 11 aligned with each other. An ordinary staple 21 has been applied to the region of the aligned corner 11. Staple 21 prevents the sheets from sliding relative to each other and thereby provides an "anti-shear" function. As used herein, the phrase "anti-shear" means a device which tends to prevent the individual sheets from sliding relative to each other. The drawings show an ordinary staple as an anti-shear device but it is to be understood that other types of devices may be used to accomplish an anti-shear function. For example, the corner region shown generally as 12 of each of the sheets may have a dry latex pressure sensitive adhesive applied. Yet another alternative is to apply toner to the corner region and remelt the toner during a xerographic process, for example, which provides an anti-shear mechanism in the corner region 12. Another alternative is to apply hot melt to the edge of the sheets as described below.

Figure 1:
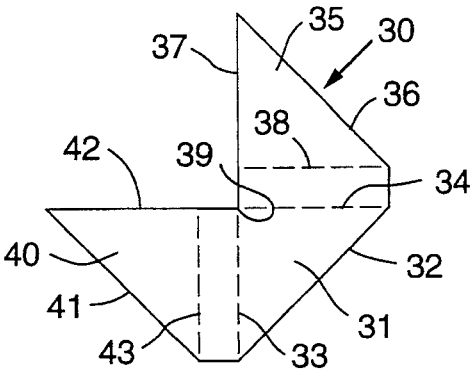
FIG. 1 is a plan view of one embodiment of a portion of the invention.

FIG. 1 shows an anti-peel means shown generally as 30 which is applied to the aligned corner 11 and, as shown and described below, it grips and encloses the corner and prevents one or more sheets from being lifted off the remaining sheets by greatly increasing the anti-peel resistance of the staple alone. The combination of the shear resistance provided by the staple 21 and the peel resistance provided by anti-peel means 30 produces an extremely effective, yet very simple and inexpensive, corner binding method and apparatus.

Figure 4:
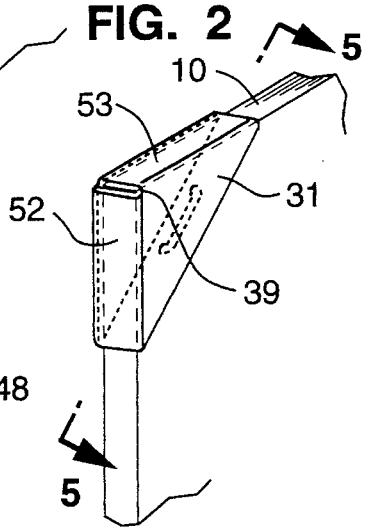
FIG. 4 is a perspective view of the apparatus of FIGS. 2 and 3 wherein the tabs of the anti-peel device have been folded around the back of the papers.

The anti-peel means 30 includes a triangular shape body 31 having a base 32 and legs 33 and 34. The triangle formed by base 32 and legs 33 and 34 is a right isosceles triangle. A first triangular tab 35 is connected to body 31. Tab 35 is a triangle formed by base 36 and legs 37 and 38. In the form shown in FIG. 1, tab 35 is formed by a right isosceles triangle which is congruent with the triangle which makes up the body portion 31. A second tab 40 is connected to body 31 and extends away from the body 31. The second tab 40 is a triangle having a base 41 and legs 42 and 43. Tab 40 is a right isosceles triangle and, in the embodiment shown in FIG. 1, that triangle is congruent with the triangles forming the body 31 and first tab 35. The purpose of the congruency of the triangles is to produce an attractive and symmetrical finished look as shown by FIG. 4 wherein the front and back of the anti-peel means 30 as applied are aligned and cover the same portion of the front and back of the stack of papers. Although the preferred embodiment shown in FIG. 1 uses congruent right triangles, other shapes may be used without departing from the invention. The body 31 may be of any shape so long as it has a corner which coincides with the corner on the stack of papers or sheets to which it is applied. Tabs 35 and 40 may be of other shapes as well, so long as the angle between their inner edges allows the tabs to be folded around to the back of the plurality of sheets. Preferably, the tabs overlap each other on the back or bottom of the stack, although the device will perform if the tabs extend onto the back of the sheets enough to adhere thereto.

Tabs 35 and 40 have inner edges 37 and 42 extending away from the body 31 as well as outer edges 36 and 41 which also extend away from body 31. Inner edges 37 and 42 intersect at a point 39. As shown best in FIG. 4, point 39 is aligned with corner 11 as the device is applied. In accordance with the invention, the inner edges 37 and 42 form an angle which may be equal to or greater than 90° but must be less than 180°. I have found that by utilizing this range of angles, the anti-peel means 30 is able to grip and enclose the corner as shown in FIG. 4 and effectively prevents pages from being separated by being lifted.

Figure 5:
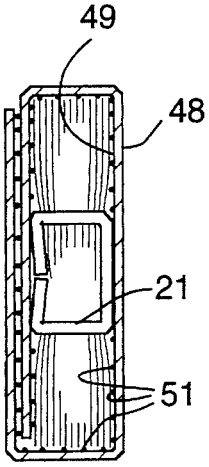
FIG. 5 is a section on the line 5—5 of FIG. 4.

The body 31 and tabs 35 and 40 form a planar body having an upper surface 48 and a lower surface 49 to which an adhesive 51 may be applied as shown best in FIG. 5.

Figure 3:
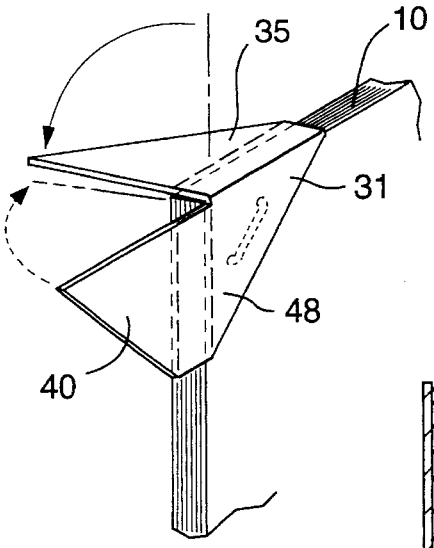
FIG. 3 is a perspective view of the apparatus shown in FIG. 2 wherein the anti-peel device has been applied over the staple and the tabs have been folded around towards the back of the stack of papers.

In the embodiment shown in FIGS. 1–5, the anti-peel means 30 is applied on top of the staple 21 as shown best in FIG. 3. In contrast, a further embodiment shown in FIGS. 18–22 has a triangular portion of the body which extends underneath the staple.

In FIGS. 1–5 rectangular spacing regions shown generally as 52 and 53 (FIG. 4) are formed between the body 31 and tabs 35 and 40 and are intended to cover a predetermined thickness of sheets. It is intended that various rectangular spacing regions will be provided, as for example one size to bind two to twenty pages and a larger size to bind twenty to forty pages. The rectangular spacing regions are formed between the legs 33 and 34 of triangular body 31 and the legs 43 and 38 of tabs 40 and 35, respectively.

The rectangular spacing regions 52 and 53 may be coated with a hot melt which, when heated, adheres to the edge of the plurality of sheets and performs the anti-shear function.

The dashed lines in FIG. 1 and in the other figures are shown for reference and do not necessarily indicate that the material has been scored. Although it is preferred to score the material around the body to make it easier for the user to fold the tabs back, it is not necessary.

Figure 6:
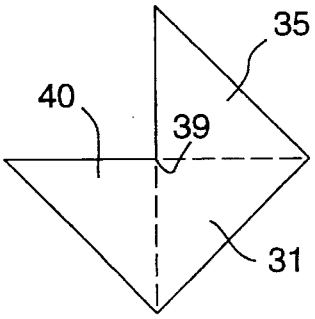
FIG. 6 is a plan view of an alternate form of the invention.
Figure 7:
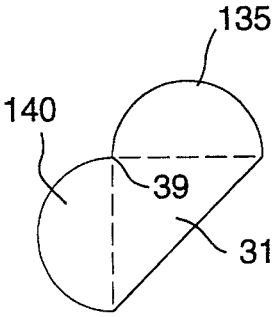
FIG. 7 is a plan view of another alternate embodiment of the invention.
Figure 8:
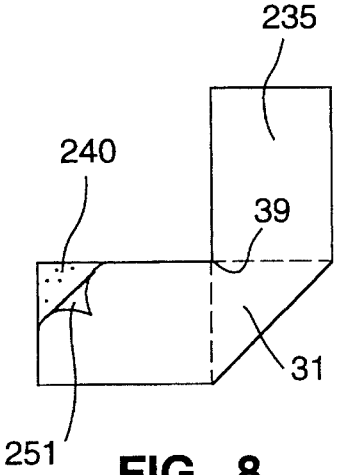
FIG. 8 is a plan view of yet another embodiment of the invention.
Figure 9:
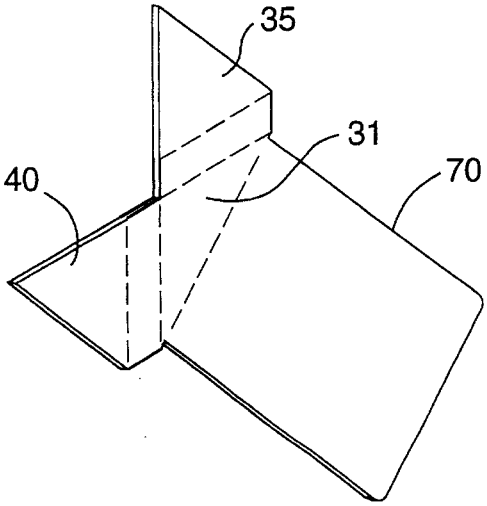
FIG. 9 is a perspective view of the anti-peel device shown in FIG. 1 to which a flag has been attached.
Figure 10:
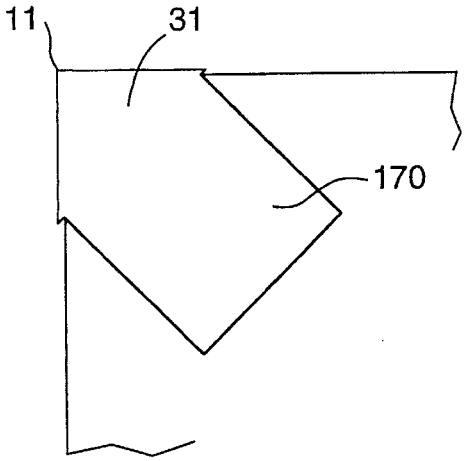
FIG. 10 is a schematic representation of the apparatus shown in FIG. 9 being applied to a plurality of papers.

FIGS. 6–8 show alternate embodiments of the invention. FIG. 6 is essentially the same as the embodiment shown in FIG. 1 without the rectangular spacing regions 52 and 53. The embodiment in FIG. 6 includes the triangular body 31 as well as triangular tabs 35 and 40.

FIG. 7 shows an alternate form having a triangular body portion 31 and tabs 135 and 140 which are semi-circular in design.

FIG. 8 shows an alternate form having a triangular body 31 and rectangular tabs 235 and 240 and release sheet 251 which is removed to expose the adhesive.

Figure 11:
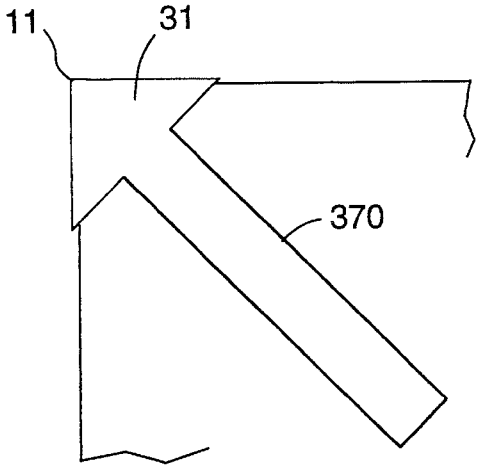
FIG. 11 is a schematic representation of an alternate embodiment wherein a diagonal flag is used in conjunction with the device.
Figure 12:
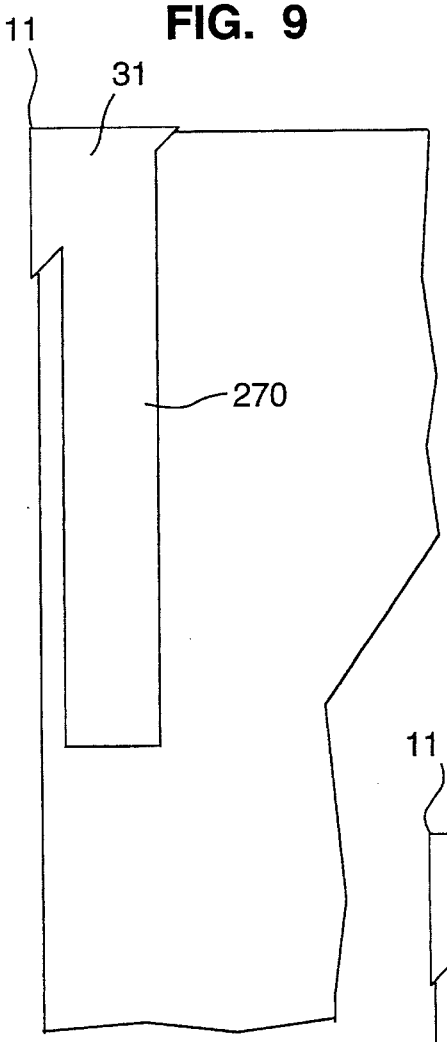
FIG. 12 is a schematic representation of another embodiment utilizing a vertical flag.
Figure 13:
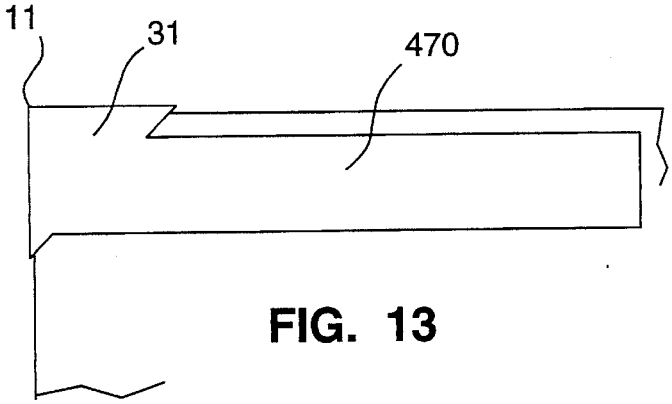
FIG. 13 shows another embodiment of the invention utilizing a horizontal flag.

FIGS. 9–13 show embodiments which utilize a flag shown generally as 70 which is a third tab carried by triangular body portion 31. The flag 70 may be essentially square in design as shown by 170 in FIG. 10. The flag may be an elongated rectangle 270, which extends vertically downwardly from corner 11 shown in FIG. 12. It may also be an elongated rectangle 370 extending diagonally as shown in FIG. 11. The flag may be an elongated rectangle 470 carried by body 31 and extending horizontally away from corner 11 as shown in FIG. 13. The flags may be of any desired shape, including shapes that are part of a company's trademark or logo. The flags may be imprinted with legends, logos or phrases (such as "1994 Federal tax return," etc.). The flags also may have a surface on which notes may be handwritten. Flags may be used with each embodiment of the invention.

Figure 14:
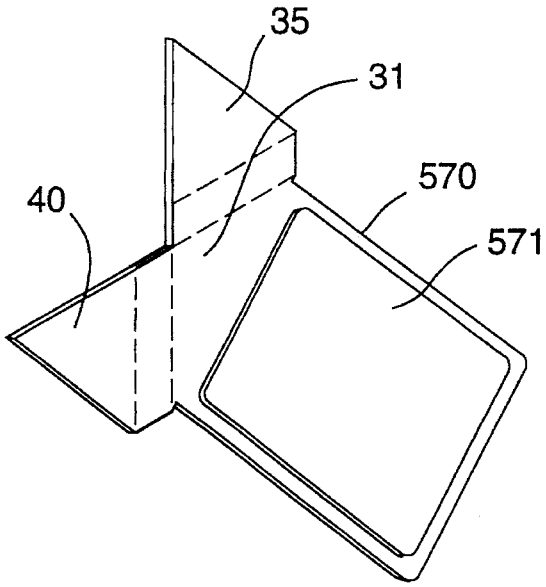
FIG. 14 is a perspective view of a further embodiment of the invention utilizing a flag carrying a removable message pad.
Figure 15:
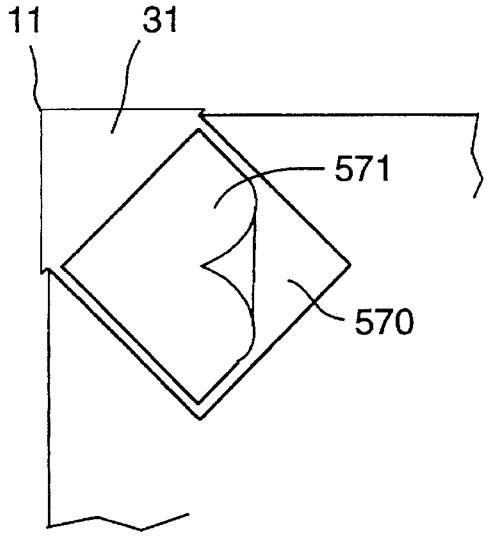
FIG. 15 is a schematic representation of the apparatus shown in FIG. 14 as applied to a plurality of sheets.

FIGS. 14 and 15 show an embodiment utilizing a flag 570 which carries a detachable sheet 571 which may be readily marked on and detached by the user for a variety of purposes.

Figure 16:
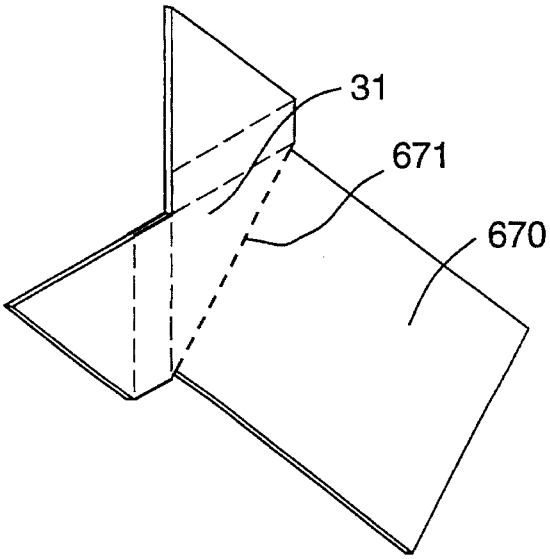
FIG. 16 is a perspective view of an alternate embodiment having a detachable flag.
Figure 17:
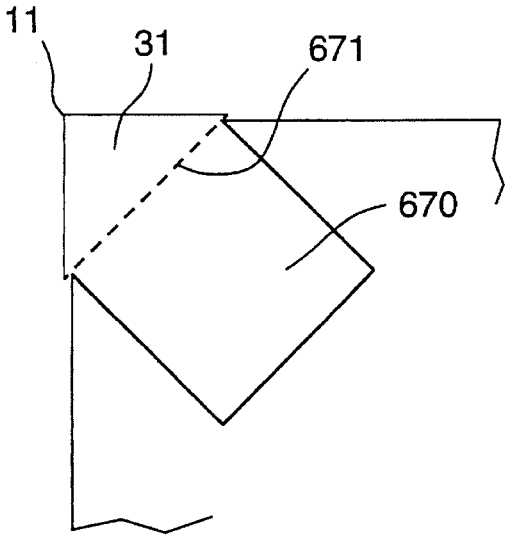
FIG. 17 is a schematic representation showing the detachable flag of FIG. 16 as applied to a plurality of papers.

FIGS. 16 and 17 show a rectangular detachable flag 670 carried by body 31 by a perforated mounting 671. In use, the flag 670 may be marked on by the user and readily detached along perforation 671.

Figure 21:
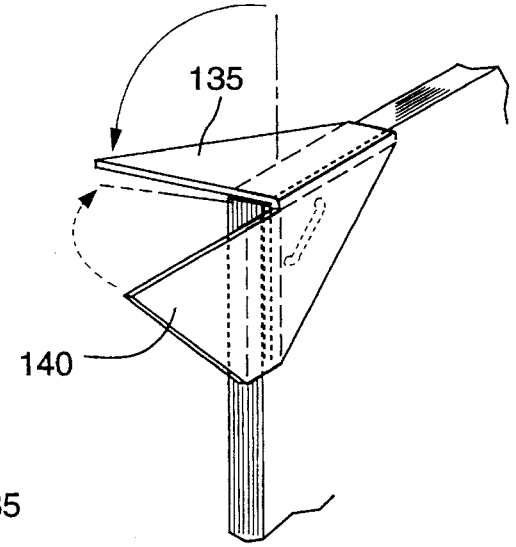
FIG. 21 shows the apparatus of FIG. 20 wherein the tabs have been folded around towards the back of the stack of papers.
Figure 22:
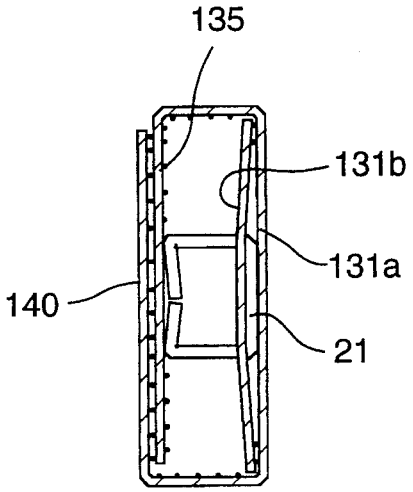
FIG. 22 is a section showing the staple as applied in FIGS. 19–21, with the tabs folded over the back of the papers.
Figure 26:
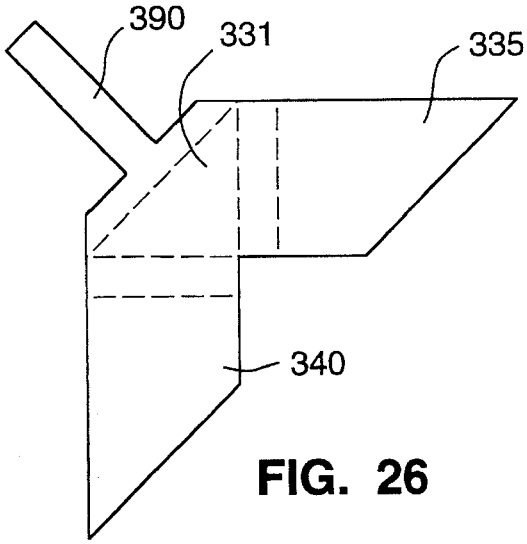
FIG. 26 is a plan view of another embodiment of the invention.
Figure 27:
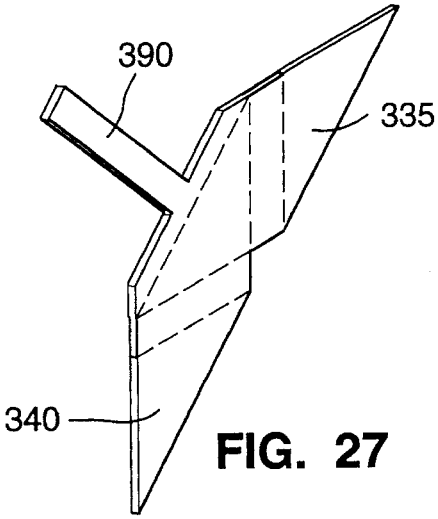
FIG. 27 is a perspective view of the corner bind of FIG. 26.
Figure 28:
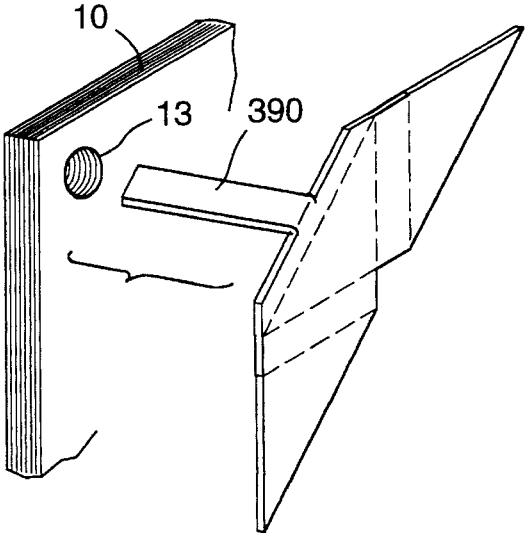
FIG. 28 is a perspective, exploded view of the apparatus of FIG. 27 as it is being applied to a plurality of sheets.
Figure 29:
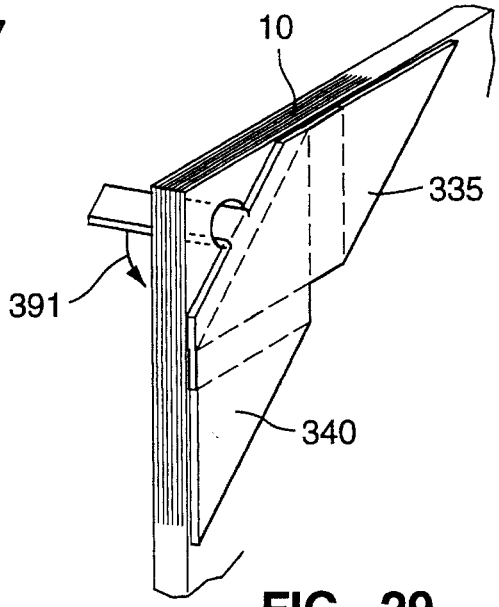
FIG. 29 shows the apparatus of FIG. 28 wherein the anti-shear tab has been inserted and extended through the hole in the stack of documents and the anti-peel corner bind is about to be folded into position.

FIGS. 18–22 show another embodiment of the invention wherein an additional triangular portion is added to the body and the staple 21 is applied through the anti-peel means shown generally as 130. In FIGS. 18–22, reference numerals in the 100-series are used to depict similar components as shown in FIGS. 1–5. Body 131 carries tabs 135 and 140. Body 131 has two triangular portions 131*a* and 131*b* which together make up a square body 131 which has a diagonal fold line 139. In use, as shown best in FIG. 9, the anti-peel means 130 is laid on the plurality of sheets 10 at corner 11 and staple 21 is applied through the fold line 139. After the staple has been inserted, release sheet 151 is removed, exposing adhesive carried by tabs 135 and 140, and the body 131 is folded over the staple 21 in the direction of arrow 9 in FIG. 20. As shown in FIG. 21, tabs 135 and 140 are then folded around the edge of the plurality of sheets and are folded on top of one another as shown in FIG. 22. As shown best in FIG. 22, triangular portion 131*b* extends partially between the staple 21 and the sheets being bound and triangular portion 131*a* covers the staple 21.

Figure 18:
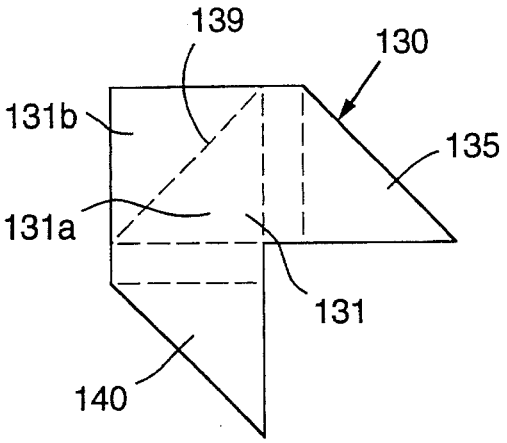
FIG. 18 is a plan view of an alternate anti-peel device through which a staple is driven.
Figure 19:
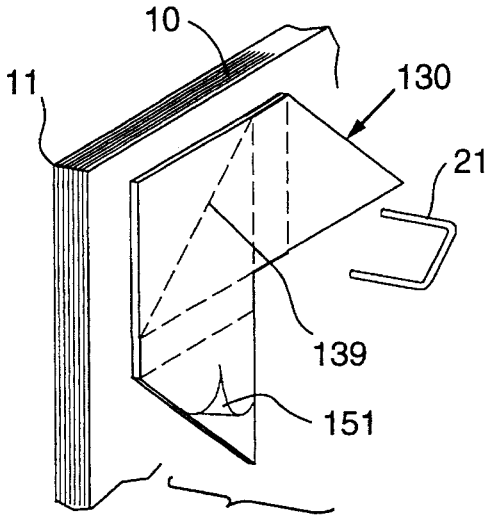
FIG. 19 is a perspective and exploded view showing the device of FIG. 18 as it is being applied over a plurality of sheets and prior to the application of the staple.
Figure 20:
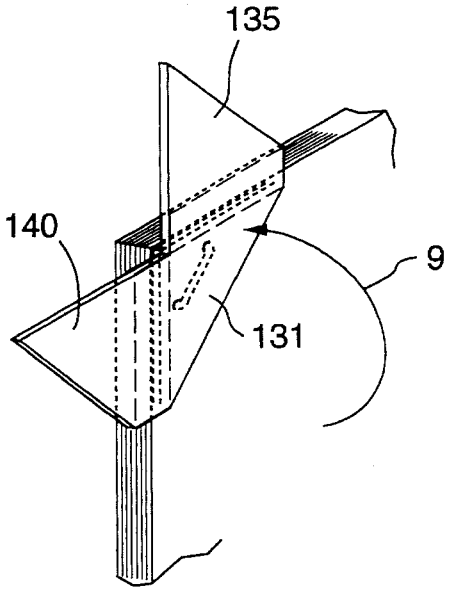
FIG. 20 shows the apparatus of FIG. 19 after the staple has been applied through the anti-peel device and the anti-peel device has been folded over the staple.

FIGS. 23, 24 and 25 show the embodiment of FIG. 18. A pressure sensitive adhesive is carried by at least the tabs 135 and 140. Before the tabs are folded into position, a release sheet 151 is removed which exposes the adhesive. FIG. 25 shows a strip 290 which carries a number of individual anti-peel means 230 which may be removed from strip 290 one at a time by the user.

FIGS. 26–29 show another embodiment wherein triangular body 331 carries tabs 335,340 and a third member 390 which is generally rectangular and which is inserted through a hole 13 which has been punched through each of the plurality of sheets 10. The member 390 is then simply folded back towards the top of the stack of papers 10 in the direction of arrow 391 of FIG. 29. Tabs 335 and 340 are then folded into position and completely cover member 390.

In this embodiment the rectangular member 390 constitutes the anti-shear means and tends to keep the individual sheets from sliding relative to each other.

Figure 30:
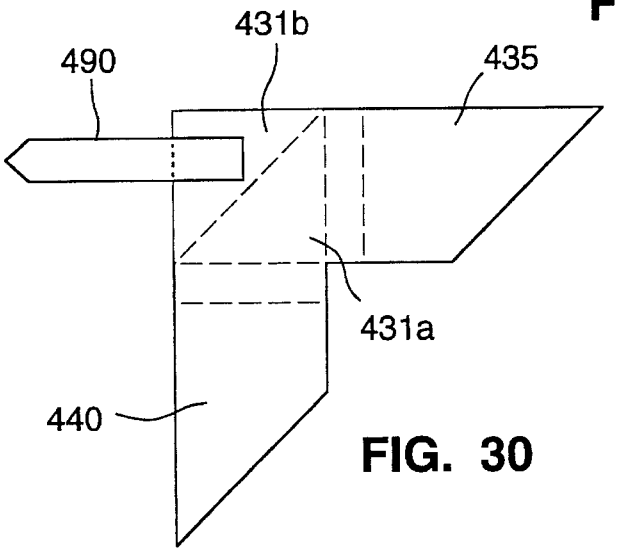
FIG. 30 is a plan view of yet another embodiment of the invention.
Figure 31:
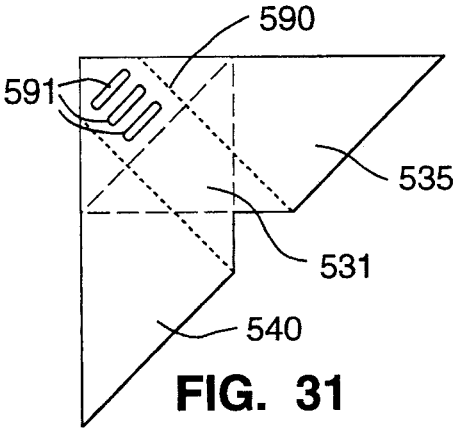
FIG. 31 is a plan view of another embodiment of the invention.

The embodiment shown in FIG. 30 is similar to that shown in FIGS. 26–29 except that the member 490 is carried by body portion 431*b*.

Figure 32:
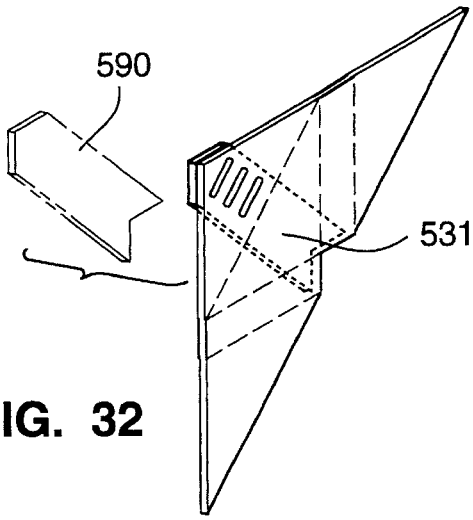
FIG. 32 is a perspective, exploded view of the embodiment shown in FIG. 31.
Figure 33:
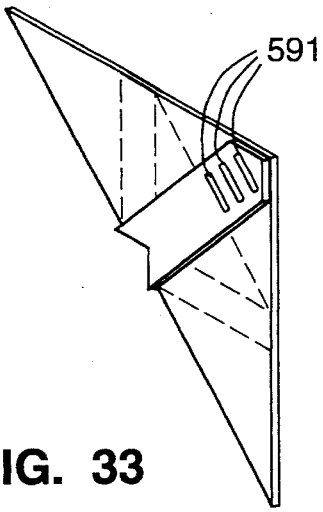
FIG. 33 is a perspective view showing the back side of the apparatus shown in FIG. 32.
Figure 34:
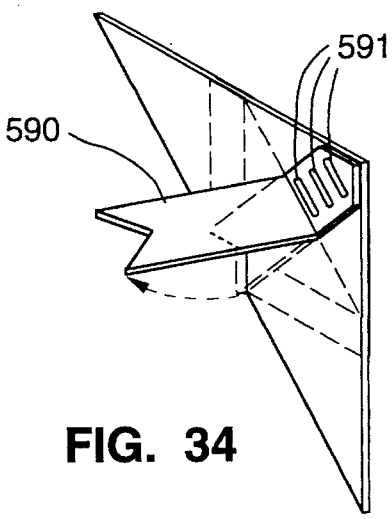
FIG. 34 is a perspective view of the apparatus shown in FIG. 33 with an anti-shear member extended and ready to insert through a hole in a stack of papers.
Figure 35:
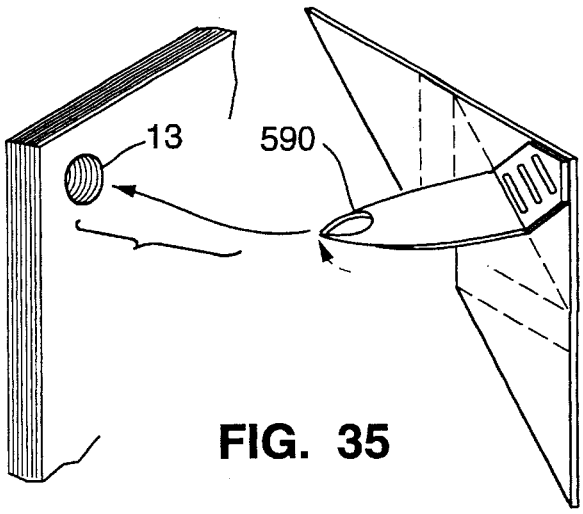
FIG. 35 is a perspective and exploded view of the apparatus of FIG. 34 as it is being applied to a stack of papers which has a hole punched in one corner.
Figure 36:
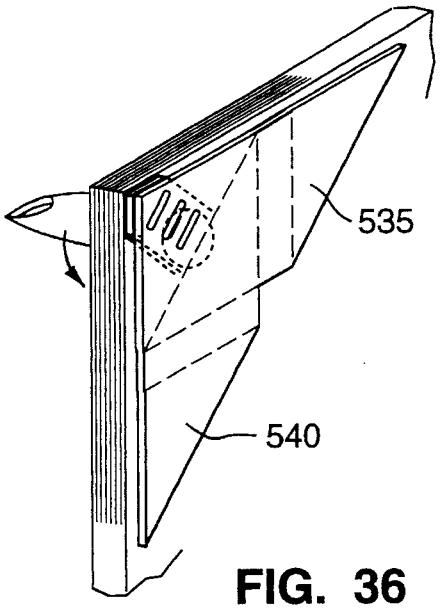
FIG. 36 shows the apparatus of FIG. 34 as applied to a stack of papers before the anti-peel device has been folded into position.

FIGS. 31–36 show yet another embodiment utilizing a bendable member 590 carried by body 531 as shown in FIG. 32 and connected to body 531 by several seal lines 591. After being bent by the user, as shown in FIGS. 34 and 35, member 590 is inserted through hole 13 and bent around toward the top of the stack of papers and covered by tabs 535 and 540.

What is claimed is:

1. A corner bind apparatus for binding together a plurality of sheets, said sheets having front and back sides and wherein said sheets have one corner aligned with each other, comprising:

anti-shear means for application to the aligned corner region of each sheet to prevent said sheets from sliding relative to each other, and anti-peel means for application to the aligned corner after application of said anti-shear means, said anti-peel means being adapted to extend fully around and grip the aligned corner to resist said sheets separating by at least one sheet being lifted off the remaining sheets wherein said anti-peel means comprises a planar body and first and second planar tabs connected to said body, said body and said first and second tabs having upper and lower surfaces and wherein said body is adapted to be applied to said front side of said plurality of sheets at said aligned corner and said first and second tabs are adapted to extend around the back side of said aligned corner whereby said first tab overlaps said second tab on said back side of said aligned corner and adhesive means carried by said lower surfaces of both of said tabs and said body so that said body and both tabs will adhere to and form a continuous surface around said aligned corner.

2. The apparatus of claim 1 further comprising rectangular spacing regions between said body and each tab, said spacing regions being sized to cover a given thickness range of said plurality of sheets.

3. The apparatus of claim 2 wherein said anti-shear means comprises a hot melt applied to said rectangular spacing regions.

4. The apparatus of claim 1 further comprising a third tab extending from said body, said third tab extending in a direction away from said aligned corner, and a surface carried by said third tab capable of having messages or logos imprinted thereon.

5. The apparatus of claim 1 wherein said body and said first and second tabs are triangular.

6. The apparatus of claim 5 wherein said body and said first and second tabs are congruent, right triangles.

7. The apparatus of claim 1 wherein said first and second tabs are semicircular.

8. The apparatus of claim 1 wherein said anti-shear means is a staple.

9. The apparatus of claim 1 wherein said anti-shear means comprises remelted toner.

10. The apparatus of claim 1 wherein said anti-shear means comprises dry pressure sensitive adhesive.

11. The apparatus of claim 1 wherein said anti-shear means comprises a member carried by said body and a hole punched through said plurality of sheets, wherein said member extends through said hole and prevents said sheets from sliding relative to each other.

12. A corner bind apparatus for binding together a plurality of sheets wherein said sheets have front and back sides and also have one corner aligned with each other, comprising:

a generally square shaped body being foldable diagonally across said square, said square body being applied to the front of said plurality of sheets at said one aligned corner, a staple extending through said body along said diagonal, said staple extending through said plurality of sheets, and said staple having first and second ends on said front and back sides of said sheets, said body being foldable on said diagonal to cover said first end of said staple, first and second triangular tabs connected to said body, said first and second tabs being foldable around said one aligned corner and overlap each other and the second end of said staple on the back side of said plurality of sheets, said body and said first and second tabs carrying adhesive means whereby a triangular portion of said body and said first and second tabs grip, extend around and adhere to said one aligned corner of said plurality of sheets and simultaneously cover said first and second ends of said staple.

13. A corner bind apparatus for binding together a plurality of sheets wherein said sheets have one corner aligned with each other and wherein said plurality of sheets has a front surface, a back surface and side edges comprising:

a staple adapted to extend through said plurality of sheets near said aligned corner, said staple having first and second exposed ends on said front and back surfaces of said plurality of sheets, a planar binder means with top and bottom surfaces having a triangular shaped body and first and second tabs extending outwardly from said body, adhesive means carried on said bottom surface of said triangular body and said tabs, said body is adapted to be placed over said first exposed end of said staple and to adhere to said front surface of said aligned corner of said sheets, and said tabs are adapted to be folded around said aligned corner, against said edges of said sheets, onto the back side of said plurality of sheets to cover said second exposed end of said staple and to overlap each other and to adhere to said back surface of said aligned corner, whereby said corner bind apparatus forms a continuous surface which extends around and adheres to said front, back and edges of said aligned corner of said plurality of sheets.

* * * * *